United States Patent [19]

Odill et al.

[11] Patent Number: 4,475,845

[45] Date of Patent: Oct. 9, 1984

[54] EXTERNAL MANHOLE CHIMNEY SEAL

[75] Inventors: Frank J. Odill, West Allis, Wis.; David E. Anderson, Elk River, Minn.

[73] Assignee: The Cretex Companies, Inc., Elk River, Minn.

[21] Appl. No.: 434,402

[22] Filed: Oct. 14, 1982

[51] Int. Cl.[3] ..... E02D 29/12

[52] U.S. Cl. ..... 404/25; 52/20; 285/226; 285/236; 277/200; 277/212 FB; 403/50

[58] Field of Search ..... 404/25, 26, 5; 52/19, 52/20, 21; 210/163, 164, 165, 166; 285/236, 226, 397, 370, 109; 277/212 FB, 200, 88, 89; 137/364, 371; 403/50, 51, 134

[56] References Cited

U.S. PATENT DOCUMENTS

| | | | |
|---|---|---|---|
| 1,254,641 | 1/1918 | Adam | 404/25 X |
| 3,294,000 | 12/1966 | Pelsue | 404/25 X |
| 3,490,794 | 1/1970 | Swanson | 285/226 X |
| 3,516,446 | 6/1970 | O'Hargan et al. | 285/109 X |
| 3,813,116 | 5/1974 | Horsley | 285/236 |
| 3,909,412 | 9/1975 | Patry | 210/166 |
| 3,958,313 | 5/1976 | Rossborough | 285/230 X |
| 4,059,293 | 11/1977 | Sipler | 285/236 |
| 4,305,679 | 12/1981 | Modi | 404/25 |
| 4,325,572 | 4/1982 | Arntyr et al. | 285/236 X |
| 4,346,922 | 8/1982 | Ohtsuga et al. | 285/109 |
| 4,368,893 | 1/1983 | Gagas | 404/25 X |
| 4,449,715 | 5/1984 | Gagas | 277/12 |

FOREIGN PATENT DOCUMENTS 2038976 7/1980 United Kingdom ..... 285/370

OTHER PUBLICATIONS

State of Michigan, Dept. of State Highways, Supplemental Specification 8.08 (2), External Type Rubber Gaskets for Sealing Culvert and Sewer Pipe Joints.

*Primary Examiner*—James A. Leppink
*Assistant Examiner*—Beverly E. Hjorth
*Attorney, Agent, or Firm*—Dorsey & Whitney

[57] ABSTRACT

A cylindrical elastomeric seal is disclosed for externally sealing a manhole assembly against surface water infiltration between the manhole casting and the supporting structure and through the supporting structure. The seal has a first sealing section adapted to receive the edge of the flange of a manhole casting, a second sealing section adapted to be received by the external surface of the manhole chimney or cone, and an intermediate section, joining the two sealing sections, that spans the vertical distance between the casting and the chimney or cone. Sealing means hold the two sealing sections in place against the casting and chimney or cone, creating watertight seals. An extension skirt increases the area the seal can cover, allowing the entire supporting structure to be sealed in the case where the chimney height is too great to be spanned by the intermediate section of the seal alone. The seal can be used on old or new construction and does not interfere with normal use of the manhole.

13 Claims, 9 Drawing Figures

EXTERNAL MANHOLE CHIMNEY SEAL

BACKGROUND OF THE INVENTION

1. Field of the Invention

This invention relates generally to the field of manhole construction. In particular, it relates to a seal which externally seals an assembly against surface water infiltration between the manhole casting and portions of the supporting structure and through the supporting structure itself.

2. Description of the Prior art

In a conventional manhole assembly a manhole casting, which constitutes the uppermost portion of the assembly and serves as the seat of a manhole cover, rests on or is fastened to a supporting structure. This supporting structure may be a manhole cone or there may be one or more adjusting rings between the cone and the casting. If the adjusting rings are used the portion of structure intermediate the casting and the cone is called the manhole chimney. The interface between the casting and the cone or adjusting ring on which it rests consists generally of two opposing flat surfaces.

In the past manhole chimneys have been constructed with precast adjusting rings, or brick or block, and have been used on manhole cones constructed with precast sections, brick or block, or cast in place concrete. Existing manholes may have had the casting shimmed with wood or bricks, with mortar placed in the gaps between shims.

One problem with conventional manhole assemblies is that surface water can infiltrate the manhole at the interfaces between the casting and the cone or between the casting and the adjusting rings, or between the adjusting rings.

As the manhole assembly ages the problem of water infiltration becomes even greater, because of deterioration in the supporting structure.

One cause of deterioration is the freeze/thaw cycle common to much of the United States during winter and spring. This causes a breakdown in the interfaces in the manhole assembly. Surface water easily infiltrates between such deteriorated interfaces.

Another cause of deterioration from prolonged use is the weight of traffic passing over the manhole. Manhole assemblies are commonly located beneath the surface of a road, with the manhole cover and top portion of the casting being flush with the road surface. The weight of the vehicles passing over the assembly commonly causes interfaces to deteriorate, and also creates cracks in the road surface surrounding the manhole assembly. Surface water runs through these cracks and infiltrates the deteriorated structure.

These same factors can also cause a vertical or horizontal displacement of the casting relative to the supporting structure, which further increases the probability of water infiltration.

Water infiltration into the sewage collection system represents a major problem in sewage treatment. The capacity of a sewage treatment system in large part is a measure of the volume of the effluent it can treat. Water infiltration during rain storms or during periods of extended rainfall activity adds to the total volume of effluent treated. This increased volume of flow may overload new and old sewage treatment systems. In most cases, the excess volume of the effluent overload is dumped untreated into rivers or lakes. It is believed that water infiltration through manhole assemblies is a primary contribution to the overloading of sewage treatment systems.

Another problem which results from surface water infiltration of manhole assemblies is the broad dissemination of contaminated surface water, especially when the contaminant is a petro chemical or dangerous man-made pollutant. Contaminated surface water which infiltrates the sewage system through a manhole will be distributed to other sites by the sewage lines or water runoff lines to which the manhole assemblies are connected. Thus, a contaminant that should be contained and disposed of safely away from population centers is, instead, widely dispersed in an uncontrolled fashion.

Consequently there is a continuing need in the field of manhole construction for an apparatus to seal the assembly against surface water infiltration. There is also a need for a seal to be effective against infiltration occurring in the area between the casting and the supporting structure and through the supporting structure. There is also a need for a seal that can accommodate vertical and horizontal displacement of the casting relative to the supporting structure during prolonged use. There is also a need for the seal to be economically manufactured and simply constructed so that it may be easily applied in the field. There is also a need for a seal that does not interfere with the normal use of the manhole.

In the prior art most inventive activity has been directed to sealing pipe sections together and to sealing ingoing and outgoing pipe at the places where it enters and leaves the lower levels of the manhole assembly. Preventing leakage at those points does not solve the problem of surface water infiltration through the supporting structure or the casting interface.

Three prior patents have been issued which relate to improvements to the placement of manhole castings.

U.S. Pat. No. 3,308,727 provides a cushion for the manhole cover but does not seal it.

U.S. Pat. No. 4,029,425 provides an extension for a manhole. A bicycle inner tube encircles the extension where the extension fits into the top of the manhole. The innertube can be inflated after the extension is in place to fill a channel between the extension and the side of the manhole. This should prevent some infiltration, but would only do so at the level of the bicycle innertube. It will not prevent infiltration at any other level in the supporting structure of the manhole.

U.S. Pat. No. 4,305,679 shows an internal sealing device to prevent water entering the joint between the manhole casing and the manhole. The seal is held in place inside the manhole assembly by two brace arrangements, each consisting of an outer expandable rim which presses the seal against the inside surface of the manhole assembly and is joined to an inner hub by threaded spokes. The brace arrangements block entrance to and exit from the manhole, thus entirely eliminating the primary function of the manhole. That is, they prevent normal use of the manhole when the seal is in place. In a second embodiment the manhole is completely sealed by a continuous membrane stretched across it.

Applicants' invention disclosed in copending U.S. patent application No. 340,232 also addresses the problems present in the field and eliminates them by providing an internal seal for a manhole assembly, which can seal the assembly against water infiltration through the interfaces between manhole casting and supporting structure while allowing for horizontal and vertical displacement of the casting relative to the supporting structure, without interfering with normal ingress to and egress from the manhole assembly. However, some uses of the manhole assembly may present a high risk of damage to an internal seal. For example, if equipment is to be routinely or repeatedly moved through the assembly the seal is more likely to be damaged. Under those circumstances an external seal is desirable. It may also be more convenient to seal externally, such as during new construction.

SUMMARY OF THE INVENTION

The present invention is used in the field of manhole construction.

The invention of the present application fills the need for an external seal which prevents water infiltration through all portions of the structure of the manhole assembly, can accommodate vertical and horizontal displacement of the manhole casting relative to the supporting structure, is economically manufactured and simply constructed and does not interfere with the normal use of the manhole.

The invention is a continuous elastomeric external cylindrical seal for use with a manhole assembly. The seal has three sections. At one end of the seal a first sealing section has an annular recess on its inner side, suitable for receiving the edge portion of the flange of a manhole casting. The inner surface of the sealing section may have annular serrations which deform to conform to the flange surface against which it is to be held.

A retaining band encircles the first sealing section. A securing band encircles the retaining band, so as to hold the retaining band and first sealing section in place once they are positioned relative to the flange.

At the other end of the cylinder is a second sealing section designed to be placed against the external surface of the manhole chimney or cone. The inner surface of the second sealing section may have annular serrations which deform to conform to the surface against which it will be held. The external surface of the second sealing section has an annular recess to receive a securing band that holds the second sealing section in place.

Intermediate the two sealing sections is a corrugated section which spans the area to be sealed and allows for vertical and horizontal movement.

A cylindrical extension skirt of elastomeric material enables the use of the seal to seal assemblies that have water permeable chimneys that are too tall to be completely spanned by the intermediate seal section, or where local codes require that the entire manhole assembly be sealed. The upper edge of the skirt is secured to the assembly at the level of the second sealing section, possibly by the securing band that holds the second sealing section in place. The lower edge is secured to the manhole cone by a securing band.

The seal, retaining band, securing bands and skirt can be manufactured to specific sizes to fit different sized manholes as specified in local codes.

As will be seen, the invention provides a seal against surface water infiltration into a previously or newly constructed manhole between the manhole casting and supporting structure and through the supporting structure. The seal can accommodate vertical or horizontal displacement of the casting occurring during prolonged use. The seal is simply constructed and is economically manufactured. It is easily applied, at the time of construction or on existing manhole assemblies that have been excavated for the purpose of repair. When in position the seal does not interfere with use of the manhole. It does not cause an obstruction in the manhole, therefore allowing normal access to and egress from it.

Accordingly, it is an objective of the invention to provide a seal for a manhole assembly to prevent surface water infiltration between the manhole casting and supporting structure and through the supporting structure.

It is an objective of the invention to provide a section intermediate the sealing sections that can span a range of vertical distances and can accommodate horizontal and vertical displacement of the casting relative to the supporting structure during prolonged use.

It is an objective of the invention to provide means to retain and secure the sealing sections in place on the manhole assembly.

It is an objective of the invention to provide inner surfaces to the sealing section that will conform to irregularities in the surfaces against which they are held, so providing an especially watertight seal.

It is an objective of the invention to provide an extension skirt that can span the lower portion of an assembly which is not spanned by the intermediate sealing section.

It is an objective of the invention to provide means to retain and secure the extension skirt in place on the manhole assembly.

These and other objects and features of the invention will become obvious to those skilled in the art upon a review of the following description in conjunction with the appended drawings.

DESCRIPTION OF THE DRAWINGS

FIG. 3, consisting of FIGS. 3*a*–3*c*, shows the preferred structure of the retaining band used on the top sealing section.

FIG. 4, consisting of FIGS. 4*a*–4*c*, shows elements of the securing bands used to secure both sealing sections to the manhole and manhole casting.

DESCRIPTION OF THE PREFERRED EMBODIMENT

Figure 1:
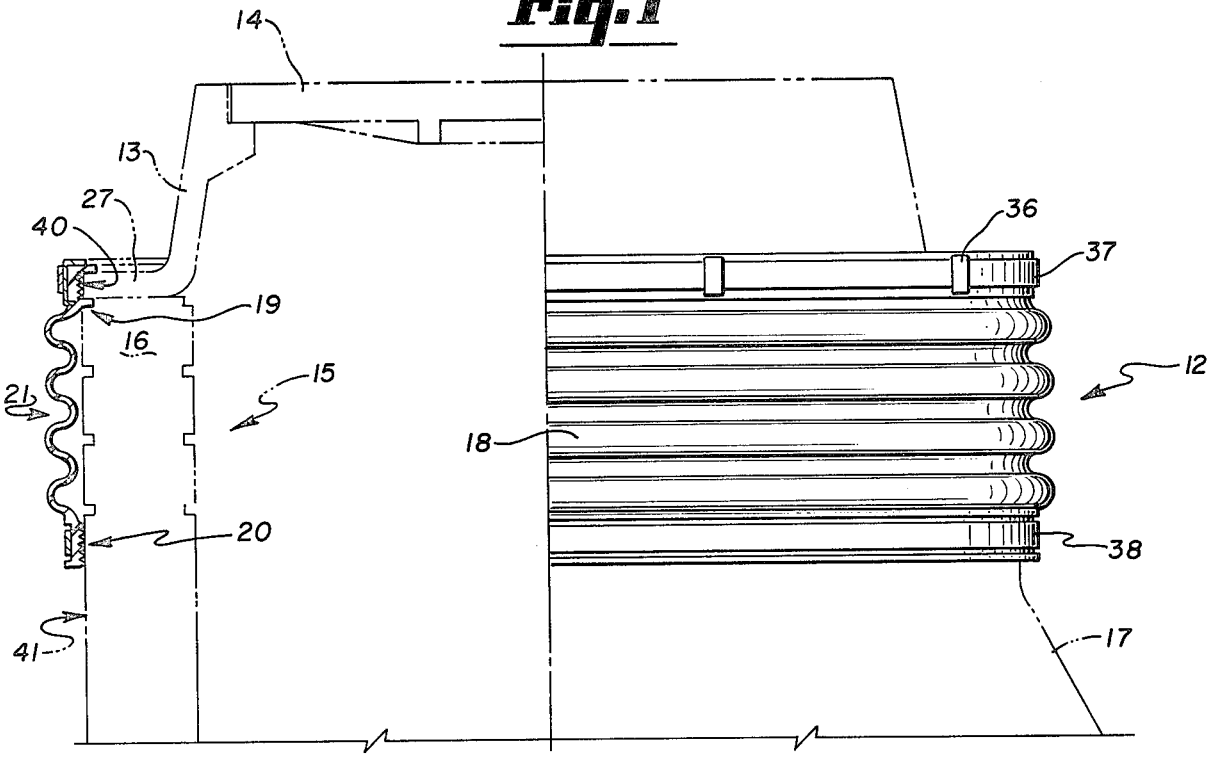
FIG. 1 is an elevational view, partly in section, of a manhole casting and cover, chimney and cone, showing how the seal of the instant invention is positioned to seal the casting to the cone.

Referring to FIG. 1, a preferred embodiment of the manhole chimney seal 12 is shown sealing a manhole casting 13, which receives a manhole cover 14, to the manhole cone 17, spanning adjusting rings 16 which constitute the manhole chimney 15. The seal functions to eliminate or substantially reduce the surface water infiltration over the area that it spans, whether the component parts are made of concrete, block or brick.

The primary function of the invention is to seal between the casting 13 and the nearest section of chimney 15 or cone 17 that is sound and impermeable to water. This may involve spanning only a short distance below the casting 13, or may require a span of part or all of the chimney 15.

Figure 2:
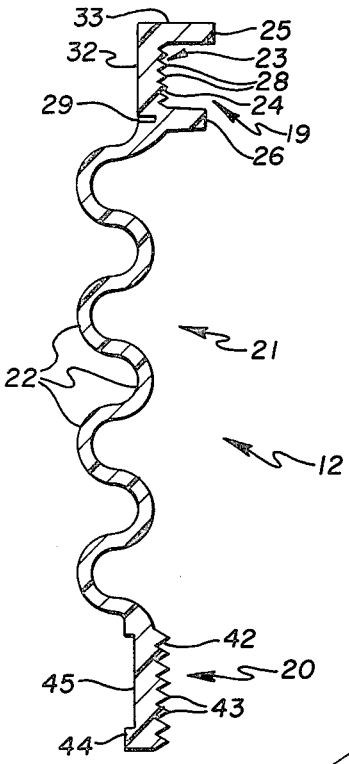
FIG. 2 is a cross section of the cylindrical elastomeric seal of our invention.

The seal 12 consists of an extruded and spliced section of elastomeric material, the cross section for which is shown in FIG. 2. Suitable materials of construction are neoprene, polyisoprene rubber compound or other elastomeric rubber or plastic type material. The seal 12 has three primary sections, a first sealing section 19, a second sealing section 20 and a section intermediate those sections 21. The intermediate section 21 has corrugations 22. The corrugations 22 allow the seal to span a range of vertical distances, allow the seal 12 to be installed where there is vertical or horizontal displacement of the manhole casting 13 relative to the chimney 15 or the cone 17, and allow the seal 12 to accommodate displacement after installation, due to frost action, shifting ground conditions, traffic loadings and the like.

The first sealing section 19 has an annular recess 23 on its inner side, giving the sealing section 19 a cross section with a vertical inner surface 24, a horizontal upper rim 25 and a horizontal lower rim 26. Dimensions of the first sealing section 19 are chosen so that the edge portion of the flange 27 of the casting 13 can be snugly fitted within the recess 23, so forming a tight seal against moisture. The vertical inner surface 24 may also have annular serrations 28 which deform under pressure so as to conform to irregularities which may exist in the flange surface 40, against which they are held, so creating an even tighter seal against water infiltration.

The outer side 32 of the first sealing section 19 has an annular slot 29, located on the same level as the lower rim 26. Slot 29 is sized to receive the lower lip 30, shown in FIG. 3*b*, of a circular retaining band 31, FIG. 3*a*.

Figure 3C:
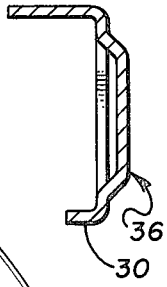
FIG. 3*c* is a cross section of the band taken along the line C—C in FIG. 3*a* showing how the retaining band is slotted to receive and contain the securing band.
Figure 3A:
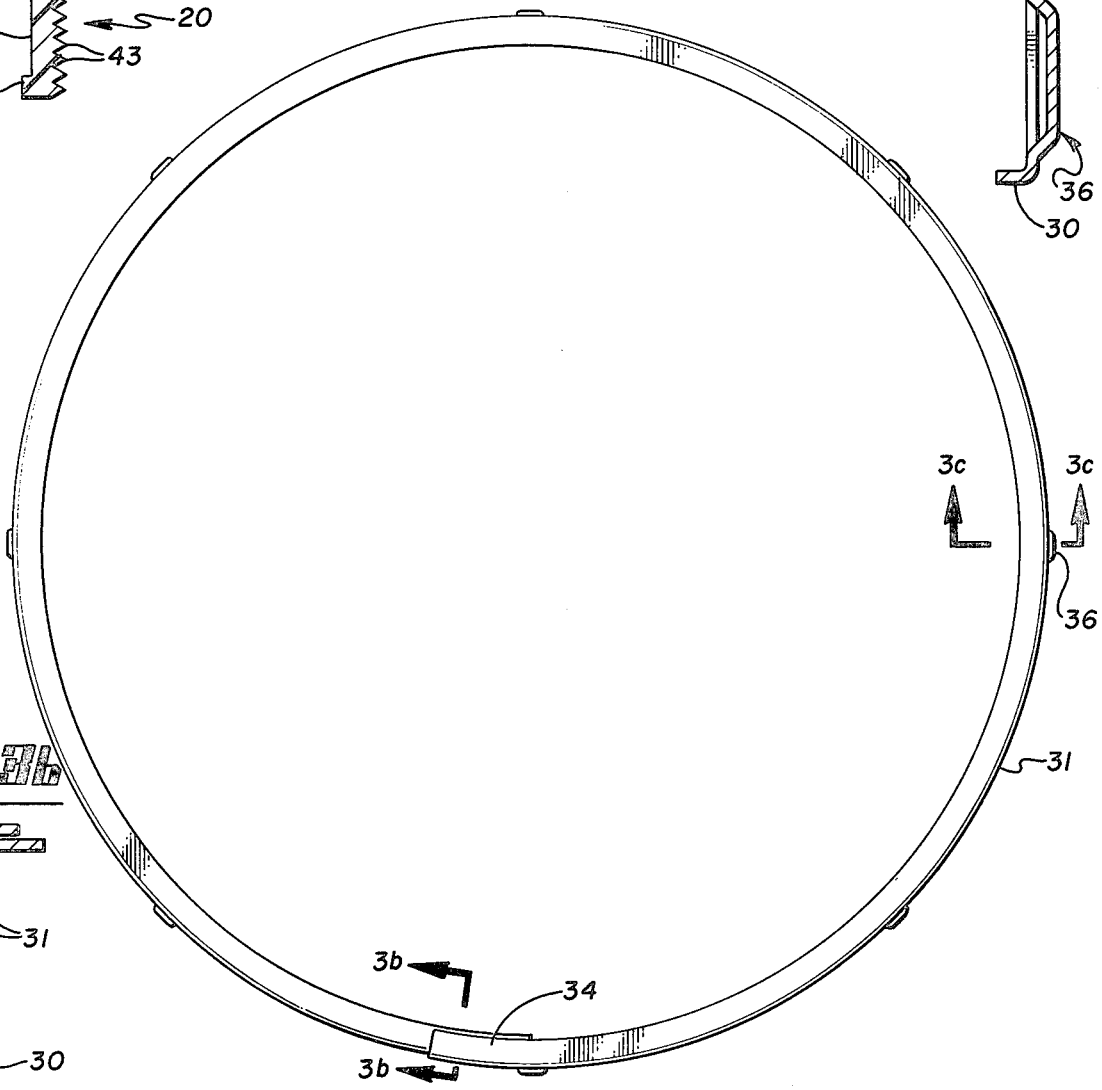
FIG. 3*a* is a top view of the band.
Figure 3B:
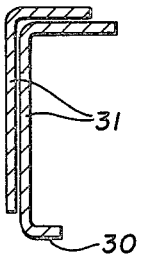
FIG. 3*b* is a cross section of the retaining band at the point of overlap.

The retaining band 31 has an inwardly facing squared-C cross section as shown in FIG. 3*b*. When the lower lip 30 is inserted into the annular slot 29, the retaining band 31 is positioned to receive the outer side 32 and a part of the top surface 33 of the first sealing section 19. The function of the retaining band 31 is to hold the first sealing section 19 in position relative to the flange 27, and to protect the first sealing section 19. The lower lip 30 on the retaining band 31 is removed at one end so as to overlap 34 with its other end, as shown in FIGS. 3*a* and 3*b*, thus completely encircling the first sealing section 19. An overlap of approximately three inches is suitable.

Raised slotted sections 36 on the circumference of band 31 allow passage through them of a first securing band 37, which holds the retaining band 31 and the first sealing section 19 in place.

The second sealing section 20 is to fit against the section of chimney 15 or cone 17 that is impermeable to water and is nearest to the casting 13. In FIG. 2 the preferred embodiment illustrates the sealing section 20 fitting against the surface 41 of the cone 17. The surface 42 of the second sealing section 20 may also have annular serrations 43 which deform under pressure to conform themselves to irregularities which may exist in the cone surface 41, to form a seal between surfaces 42 and 41 that is watertight.

The outer surface 44 of the second sealing section 20 has an annular recess 45 of dimensions to accommodate a second securing band 38, which holds the second sealing section 20 in place.

Figure 4A:
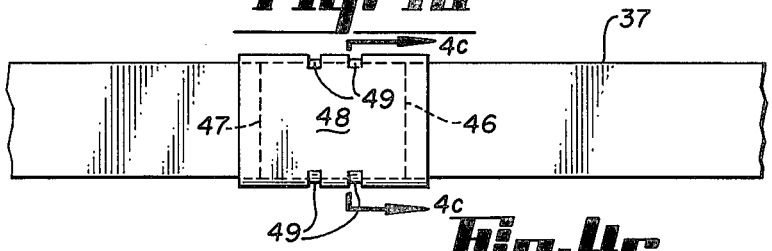
FIG. 4*a* is a side view of the ends of a band sealed by a crimped clamp.
Figure 4B:
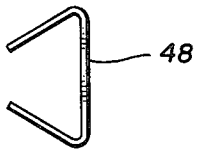
FIG. 4*b* is a side view of a clamp.
Figure 4C:
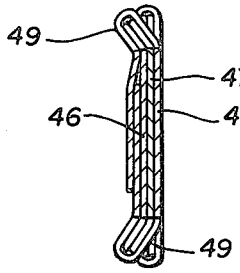
FIG. 4*c* is a cross section of the band and clamp taken along the line C—C in FIG. 4*a*.

The securing bands 37, 38 are flat strips of material such as stainless steel. Referring to FIGS. 4*a*–4*c*, the ends 46, 47 of bands 37, 38 can be pulled together by a conventional ratchet-action tool until they overlap and bands 37, 38 tightly bind their respective associated sealing sections in place. The ends can then be sealed by crimping a clamp 48 at two or more crimping points 49 so as to mechanically lock the ends together.

Figure 5:
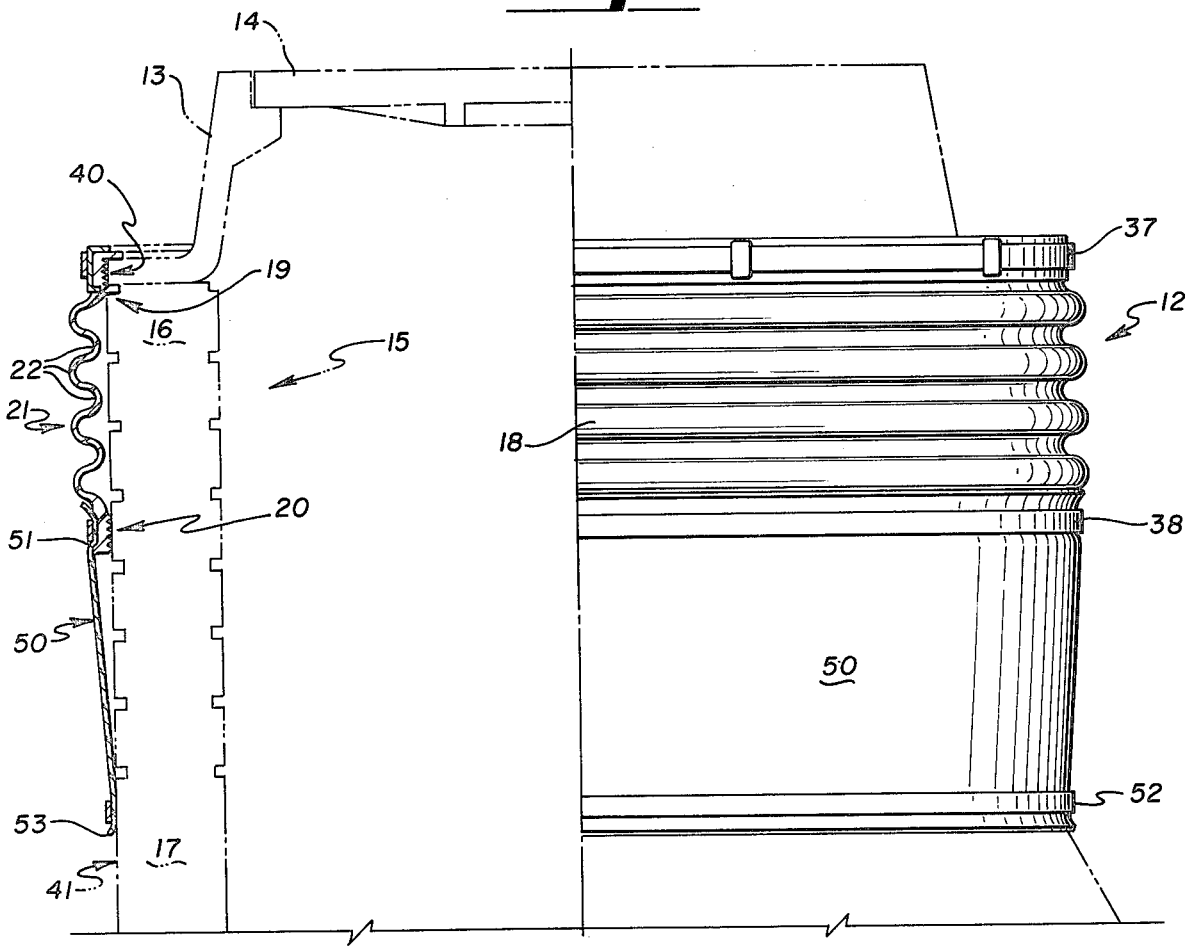
FIG. 5 is an elevational view, partly in section, of the manhole casting cover, chimney and cone, showing an alternative embodiment of the seal of the present invention, which incorporates an extension skirt to increase the area covered by the seal.

Referring to FIG. 5, an alternative embodiment of the seal is shown. An extension skirt 50 is used to span a further vertical distance, between the second sealing section 20 and the manhole cone 17. This may be used in a situation where the lower section of the manhole chimney 15 is unsound and water permeable and the chimney 15 is too tall to be spanned by the intermediate section 21 alone. The second securing band 38 is shown holding both the upper portion 51 of the skirt and the second sealing section 20 in place against a surface of the chimney 15. A third securing band 52 holds the lower portion 53 of the skirt 50 against the surface 41 so as to form a watertight seal. This may be at the lower edge of the skirt, as shown, or may be at a higher level on the skirt, depending on the height of the chimney 15 that remains uncovered by the seal 12. With the skirt 50 in place the entire supporting structure of the manhole is sealed against infiltrating surface water.

Suitable materials for construction of the extension skirt are polyisoprene, neoprene or other rubber material, or a flexible vinyl or polyethylene material. A suitable thickness range for the material of the skirt is from a few thousandths of an inch to one-sixteenth of an inch. The skirt may be constructed of a continuous band of material, vulcanized or glued before installation, or may be constructed of multiple overlapping sections. The overlapped sections may be sealed by adhesive, or can be sealed by the pressure of the surrounding soil.

Securing bands 37, 38, 52, retaining band 31, seal 12 and extension skirt 50 can also be manufactured to specific sizes to fit different sized manholes as specified in local codes.

In order for the seal to be effective in preventing water infiltration the cone surface 41 that is chosen to receive the second sealing section 20 must be sound and impermeable to water. In addition both the flange surface 40 and the cone surface 41 must be reasonably smooth and free of any loose material or excessive voids in order to create a tight seal with their respective sealing sections. Before installation of the seal 12 both surfaces are brushed with a wire brush to remove loose material and to clean the surfaces. Any major flaws in the flange surface 40 can then be repaired by either grinding smooth or filling with mortar. If the cone surface 41 is very rough or irregular it can be smoothed with mortar.

Joining material such as mortar is placed between the flange 27 and the chimney 15, leaving a space for the insertion of the lower rim 26 between the casting 13 and the chimney 15.

In old construction, where the upper portion of the manhole has been excavated in order to gain access to the manhole assembly for repair, old joining material is removed and replaced with new joining material.

The inner sides of both sealing sections 19, 20 are first lubricated with gasket lube to aid in sliding the seal 12 over the manhole assembly. The flange surface 40 and external surface of the chimney 15 or cone 17 may also be lubricated. The seal 12 is then installed by placing it over the manhole assembly so that it encircles the assembly, with the first sealing section 19 at the level of the flange 27 and the other sections of the seal 12 hanging downwards. The first sealing section 19 is fitted over the edge portion of the flange 27 so that the edge portion is inserted into the recess 23 and the inner surface 24 of the first sealing section 19 and the flange surface 40 are in contact.

The lower lip 30 of the retaining band 31 is then inserted into the annular slot 29, so that the outer side 32 and a portion of the top surface 33 of the first sealing surface 19 are within the retaining band 31. The ends of the retaining band are overlapped 34 sufficiently for the retaining band 31 to closely encircle the first sealing section 19.

The first securing band 37 is lubricated and threaded through the slots 36. If preferred this can be done before the retaining band 31 is put in place. The first securing band 37 is tightened and sealed as described above, to hold the retaining band 31 and the first sealing section 19 in place against the flange 27. The retaining band prevents any upward movement of the seal 12 during use and also serves to protect the first sealing section 19.

The second securing band 38 is lubricated and is inserted in the annular recess 45 of the second sealing section 20. Downward pressure is applied to the second sealing section 20 to extend the intermediate section 21 until the second sealing section 20 is level with the already prepared surface 41 or a surface of the chimney 15. The second securing band 38 is then tightened and sealed, as described above, to hold the second sealing section 20 in place against the surface 41 or a surface of the chimney 15.

As the seal formed between each seal section and its respective associated manhole assembly surface is watertight, and as the seal 12 has been positioned so as to span all unsound and waterpermeable sections of the chimney 15 or cone 17, the result is to eliminate, or at least substantially reduce, infiltration of surface water into the manhole.

In the alternative embodiment the skirt 50 is lubricated and slid over the manhole assembly and positioned over the lower portion of the assembly, before the seal 12 is positioned at the top portion of the assembly. The second sealing section 20 is slid within the upper portion 51 of the skirt 50. The securing band 38 is lubricated and is inserted external to the upper portion 51 of the skirt, within the annular recess 45, so as to hold the upper portion 51 between the securing band 38 and the second sealing section 20. The securing band 38 is tightened as described above, to hold the upper portion 51 and the second sealing section 20 against a surface of the chimney 15. Alternatively, the second sealing section 20 is secured by the second securing band 38, and the upper portion 51 of the skirt 50 is positioned over the second securing band 38. An additional securing band is then placed to encircle the upper portion 51 of the skirt 50 and is tightened and sealed as is securing band 38, to hold the upper portion 51 in position.

The skirt 50 hangs downwards from its secured upper portion 51 to cover the section of the chimney 15 that is not spanned by the seal 12. The third securing band 52 is placed around the skirt 50 at a level where the skirt 50 encircles the top of the manhole cone 17. The third securing band 52 is tightened as is the second securing band 38, to hold the lower portion 53 of the skirt 50 tightly against the surface 41 of the manhole cone 17. Any part of the skirt 50 hanging below the third securing band 52 can be trimmed or left hanging.

As the skirt 50 spans a section of the chimney 15 that was left uncovered by the seal 12, and as the securing bands 38 and 52 create watertight seals between the skirt 50 and the second sealing section 20 and the skirt 50 and the surface 41 of the cone 17, the entire manhole assembly is effectively sealed against surface water infiltration.

It is clear from a consideration of the foregoing disclosure that the invention is a simply constructed and economically manufactured seal which overcomes problems presently existing in the subject matter to which the invention relates. While a specific preferred embodiment has been disclosed in detail, it is obvious to those skilled in the art that a differently shaped or configured sealing means can be utilized in a similar manner to achieve the objective of the invention. As an example, tightening or fastening of the securing rings can be achieved with other means well known to those skilled in the art. As further examples, the cross-sections of various components could differ from those shown and still perform as the invention is intended. It should be understood that the modifications and variations may be resorted to without departing from the spirit of the invention and that such modifications and variations are considered to be within the purview and scope of the present invention as defined by the following claims.

I claim as my invention:

1. In a manhole assembly comprising a manhole casting having a flange and a manhole the improvement comprising:

a generally cylindrical sealing means of elastromeric material for externally sealing said manhole assembly against infiltration of water said sealing means comprising;

a first sealing section with an inner side, an outer side and a top surface, said inner side having an annular recess therein so as to present a cross section having a vertical inner surface and horizontal upper and lower rims, said annular recess being of dimensions suitable to receive said edge portion of said flange;

a second sealing section having an inner side and an outer side, said inner side being adapted to be received by the external surface of said manhole;

an axially expandable intermediate section joining said first and second sealing sections, said intermediate section spanning the vertical distance between said manhole casting and said manhole; and securing means encircling the exterior of the sealing means for retaining the sealing means in a sealed relationship to the external surface of the manhole assembly, said securing means comprising;

a means for securing said first sealing section to said flange of the manhole casting; and a means for securing said second sealing section to said manhole.

2. The improvement of claim 1 wherein said manhole comprises a manhole chimney having an external surface and a manhole cone having an external surface within said second sealing section is secured to said external surface of said manhole chimney.

3. The improvement of claim 2 wherein said sealing means further comprises a skirt of elastomeric material having an upper portion and a lower portion.

4. The improvement of claim 3 wherein said sealing means further comprises a means for securing said upper portion of said skirt to said manhole chimney.

5. The improvement of claim 3 wherein said sealing means further comprises a means for securing said lower portion of said skirt to said external surface of said manhole cone.

6. The improvement of claim 3 wherein said upper portion of said skirt is secured to said manhole chimney by the same means that secures said second sealing section to said external surface of said manhole chimney.

7. The improvement of claim 1 wherein said flange has a mating surface and wherein the vertical inner surface of said first sealing section has a plurality of annular serrations for filling irregularities in the flange surface against which they are pressed.

8. The improvment of claim 1 wherein said outer side of said first sealing section has an annular slot therein, said annular slot being located generally at the level of said lower rim of said first sealing section, and wherein said improvement further comprises:

a circular retaining band having an upper and lower lip to provide an inwardly facing squared-C cross section and being of dimensions suitable to receive said outer side and a portion of said top surface of said first sealing section when said lower lip of said retaining band is inserted within said annular slot;

said retaining bank formed at one end so as to overlap with its other end to completely encircle said first sealing section;

said retaining band also having at intervals on its outer circumference a plurality of sections raised above the general surface level, said section having slots so as to allow a circular securing band to pass through said slots and to be held adjacent to said retaining band; and a circular securing band to secure said first sealing section and said retaining band to said manhole casting flange.

9. The improvement of claim 1 wherein said inner side of said second sealing section has a plurality of annular serrations for filling irregularities in the surface against which they are pressed.

10. The improvement of claim 1 wherein said outer side of said second sealing section has an annular recess therein to receive a circular securing band, and wherein the improvemnt further comprises a securing band to secure said second sealing section to said surface of said manhole.

11. The improvement of claim 1 wherein said intermediate section is corrugated to allow for vertical and horizontal displacement of said manhole casting relative to said manhole.

12. The improvement of claim 1 or claim 8 or claim 10 wherein the improvement further comprises fastening means to tighten and to lock said securing band so as to secure said sealing section in place against the surface being sealed.

13. The improvement of claim 1 wherein said manhole comprises a manhole cone on which said manhole casting is mounted and wherein said intermediate section is corrugated to allow for vertical and horizontal displacement of said manhole casting relative to said manhole cone.

* * * * *